US009768531B1

(12) United States Patent
Schlaupitz et al.

(10) Patent No.: US 9,768,531 B1
(45) Date of Patent: Sep. 19, 2017

(54) GROUNDING BUSHING AND A METHOD OF USING THE GROUNDING BUSHING TO PROVIDE A GROUND CONNECTION BETWEEN A COMPONENT AND A VEHICLE BODY RAIL

(71) Applicant: GM Global Technology Operations LLC, Detroit, MI (US)

(72) Inventors: Christopher A. Schlaupitz, Warren, MI (US); Daniel F. Witting, Sterling Heights, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 15/192,048

(22) Filed: Jun. 24, 2016

(51) Int. Cl.
*H01R 4/64* (2006.01)
*H01R 4/66* (2006.01)

(52) U.S. Cl.
CPC ..... *H01R 4/66* (2013.01); *H01R 2201/26* (2013.01)

(58) Field of Classification Search
CPC ... H01R 4/64; H01R 13/65802; F16B 5/0233; F16B 43/00
USPC ..... 439/92; 411/546
See application file for complete search history.

(56) References Cited

U.S. PATENT DOCUMENTS 759,599 A * 5/1904 Ette ..... F16B 5/0233 411/546
3,362,737 A * 1/1968 Cobb ..... F16B 5/02 403/373
6,176,666 B1 * 1/2001 Osterlund ..... F16B 5/02 411/535
6,344,972 B2 * 2/2002 Estieule ..... H01R 4/64 361/753
8,240,966 B2 * 8/2012 Figge ..... F16B 5/0233 411/546
2002/0150445 A1 * 10/2002 Ozawa ..... F16B 5/0233 411/546
2006/0237210 A1 * 10/2006 Cheng ..... H02G 3/0616 174/51
2013/0034409 A1 * 2/2013 Haworth ..... F16B 43/009 411/538
2014/0261640 A1 * 9/2014 Andrews ..... B21D 22/00 136/251
2015/0311638 A1 * 10/2015 Smith ..... H01R 13/655 174/78

* cited by examiner

*Primary Examiner* — Gary Paumen

(57) ABSTRACT

A method according to the present disclosure provides a ground connection between a first component and a vehicle body rail through a coating disposed on the vehicle body rail. The method includes inserting a grounding bushing into an aperture in a second component, positioning the second component between the first component and the vehicle body rail, placing the grounding bushing in contact with the first component, and inserting a fastener through the first component, through the grounding bushing, and into the vehicle body rail. The method further includes tightening the fastener to clamp the first component and the grounding bushing between a head of the fastener and the vehicle body rail and thereby cause the grounding bushing to pierce through the coating disposed on the vehicle body rail to provide the ground connection between the first component and the vehicle body rail.

20 Claims, 2 Drawing Sheets

GROUNDING BUSHING AND A METHOD OF USING THE GROUNDING BUSHING TO PROVIDE A GROUND CONNECTION BETWEEN A COMPONENT AND A VEHICLE BODY RAIL

FIELD

The present disclosure relates to grounding bushings and to methods of using a grounding bushing to provide a ground connection between a component and a vehicle body rail.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Various components of a vehicle are electrically grounded by providing a ground connection between the components and a body rail of the vehicle. However, the body rail is typically covered with an electro paint operation (ELPO) coating, a regular paint coating, and/or an oxidation coating that inhibits corrosion of the body rail and inhibits the ground connection. Thus, methods have been developed to create a direct ground connection between a component and the body rail.

In one example, a stud is welded to the body rail and a nut is assembled to the stud before an ELPO coating is applied to the body rail to prevent the ELPO coating from covering the stud. Then, after the ELPO coating is applied, the nut is removed from the stud, a ground strap is placed over the stud, and the nut is reassembled to the stud to retain the ground strap on the stud. The other end of the ground strap is then attached to a stud that is welded to the component, and a nut is assembled to the component stud to secure the other end of the ground strap to the component stud.

Welding the studs to the body rail and the component and assembling/disassembling the nuts increase the amount of labor effort and time required to create the ground connection. In addition, this increase in the amount of labor effort and time, coupled with the cost of the grounding hardware, increases the cost of the vehicle. Further, in various applications, masking of joints is not feasible and/or is cost prohibitive. Therefore, a need exists to provide a direct ground connection between a vehicle component and a body rail while minimizing the labor effort, labor time, and cost associated with providing the ground connection.

SUMMARY

A grounding bushing according to the present disclosure provides a ground connection between a first component and a vehicle body rail through a coating disposed on the vehicle body rail. The grounding bushing includes an annular body and a piercing body. The annular body is configured to be inserted into an aperture in a second component disposed between the first component and the vehicle body rail. The annular body has a first surface configured to face the vehicle body rail and a second surface opposite of the first surface and configured to contact the first component. The annular body defines an aperture configured to receive a fastener for securing the first component to the vehicle body rail. The piercing body projects from the first surface of the annular body and is configured to pierce through the coating disposed on the vehicle body rail to provide the ground connection between the first component and the vehicle body rail when the fastener is tightened to secure the first component to the vehicle body rail.

A method according to the present disclosure provides a ground connection between a first component and a vehicle body rail through a coating disposed on the vehicle body rail. The method includes inserting a grounding bushing into an aperture in a second component, positioning the second component between the first component and the vehicle body rail, placing the grounding bushing in contact with the first component, and inserting a fastener through the first component, through the grounding bushing, and into the vehicle body rail. The method further includes tightening the fastener to clamp the first component and the grounding bushing between a head of the fastener and the vehicle body rail and thereby cause the grounding bushing to pierce through the coating disposed on the vehicle body rail to provide the ground connection between the first component and the vehicle body rail.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Figure 1:
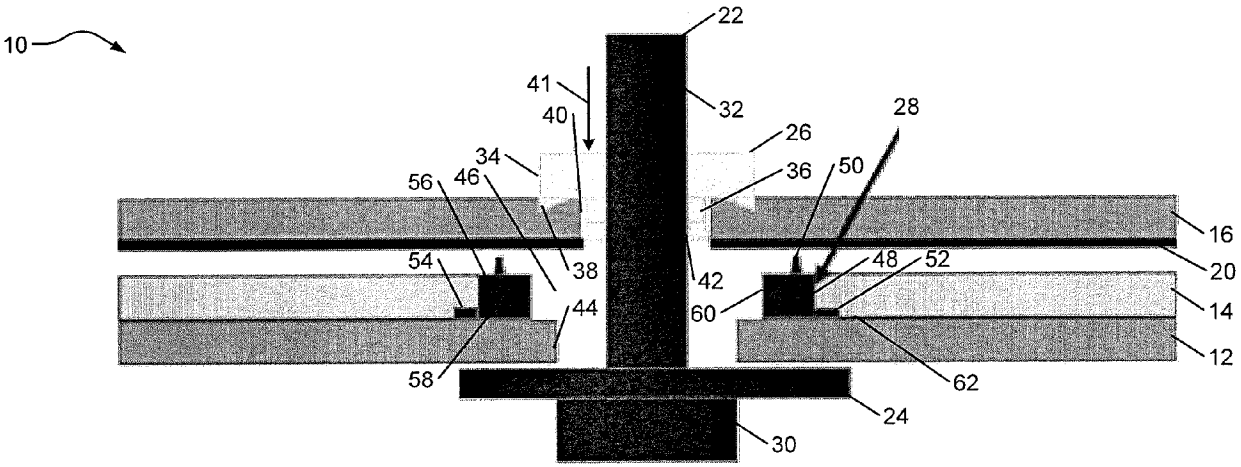
FIG. 1 is a section view of an example of a grounding joint according to the present disclosure when the grounding joint is only partially assembled.
Figure 2:
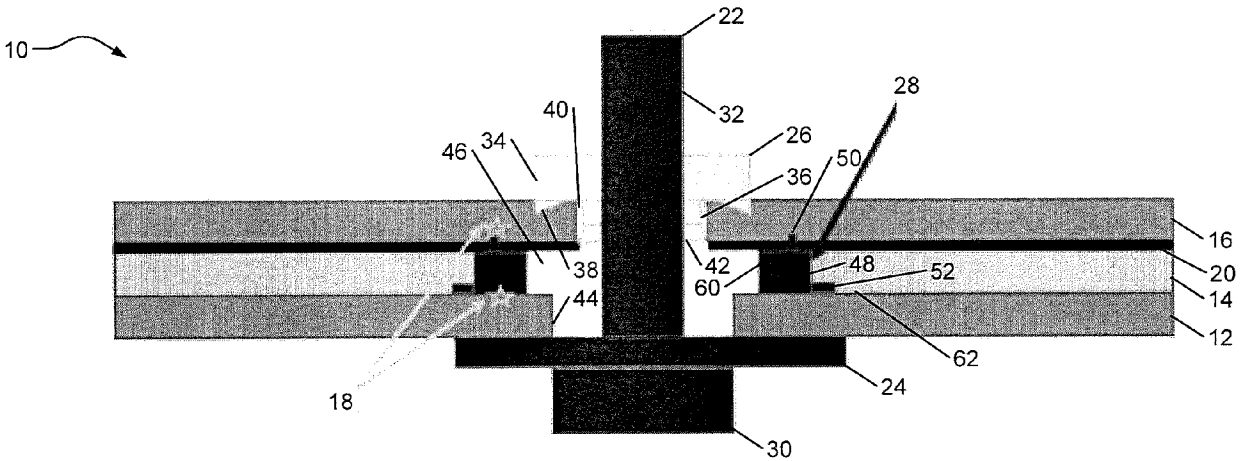
FIG. 2 is a section view of the grounding joint of FIG. 1 when the grounding joint is fully tightened.

Referring now to FIGS. 1 and 2, a grounding joint 10 according to the present disclosure secures a tray 12 of a battery pack and a cover 14 of the battery pack to a body rail 16 of a vehicle. In addition, the grounding joint 10 provides a direct ground connection or path 18 between the tray 12 and the body rail 16 through a coating 20 disposed on the body rail 16. The tray 12 may be grounded to prevent electromagnetic noise from leaving the vehicle and/or to provide a negative return path for the battery pack.

The tray 12 may be formed of a conductive material (e.g., steel), the cover 14 may be formed of a non-conductive material (e.g., plastic), and the body rail 16 may be formed of a conductive material (e.g., aluminum, steel). The coating 20 may include an electro paint operation (ELPO) coating, a paint coating, and/or an oxidation coating. The coating 20 may cover the entire outer surface of the body rail 16.

The grounding joint 10 includes a bolt 22, a washer 24, a clinch nut 26, and a grounding bushing 28. The bolt 22 may be an M8 bolt or another size suitable for an electrical joint, and the clinch nut 26 may be a comparably sized fastener such as an M8 clinch nut. The bolt 22, the washer 24, and the clinch nut 26 may be formed of a conductive material or a non-conductive material.

The grounding bushing 28 may be formed of a material that is harder than the material of which the body rail 16 is formed. For example, if the body rail 16 is formed of steel, the grounding bushing 28 may be formed of hardened steel. In another example, if the body rail 16 is formed of aluminum, the grounding bushing 28 may be formed of any steel (e.g., hardened steel or unhardened steel).

The bolt 22 includes a head 30 and a shank 32. The shank 32 may be threaded. The washer 24 may be integrally formed with the bolt 22 or formed separate from the bolt 22 and slid onto the shank 32 of the bolt 22. In either case, the washer 24 may be captured or otherwise secured against the head 30 of the bolt 22.

The clinch nut 26 includes a head 34, a shank 36, and a piercing body 38 protruding from the head 34. The shank 36 may be unthreaded and may be inserted into an aperture 40 in the body rail 16. The piercing body 38 may include a ring having a sharp distal end, or the piercing body 38 may include a plurality of teeth. When the shank 36 is at least partially inserted into the aperture 40, a force 41 may be applied to the head 34 to cause the piercing body 38 to bite into (e.g., penetrate) the body rail 16.

The clinch nut 26 defines an aperture 42 that extends through the head 34 and the shank 36 and is configured to receive the shank 32 of the bolt 22. The tray 12 and the cover 14 define apertures 44 and 46, respectively, which are also configured to receive the shank 32 of the bolt 22. The aperture 42 may be threaded, and the apertures 44 and 46 may be unthreaded. The bolt 22 may be tightened by threading the shank 32 of the bolt 22 into the aperture 42 in the clinch nut 26.

The grounding bushing 28 is inserted into the aperture 46 in the cover 14 and may be secured within the aperture 46 using a press fit. The grounding bushing 28 may act as a spacer to prevent the cover 14 from being over compressed when the bolt 22 is tightened. In addition, the grounding bushing 28 provides the ground path 18 between the tray 12 and the body rail 16 through the coating 20 disposed on the body rail 16.

The grounding bushing 28 includes an annular body 48, a piercing body 50, and an annular flange 52 projecting radially outward from the annular body 48. The grounding bushing 28 may be inserted into the aperture 46 in the cover 14 until the annular flange 52 abuts a shoulder 54 on the cover 14. In this regard, the shoulder 54 may act as a stop. The annular body 48 has a first surface 56 facing the body rail 16 and a second surface 58 opposite of the first surface 56. The annular body 48 defines an aperture 60 that is configured to receive the shank 32 of the bolt 22.

The piercing body 50 projects from the first surface 56 and is configured to pierce through the coating 20 and bite into (e.g., penetrate) the body rail 16 when the bolt 22 is tightened as shown in FIG. 2. The piercing body 50 may include a ring having a sharp distal end. Alternatively, the piercing body 50 may include a plurality of teeth.

Figure 3:
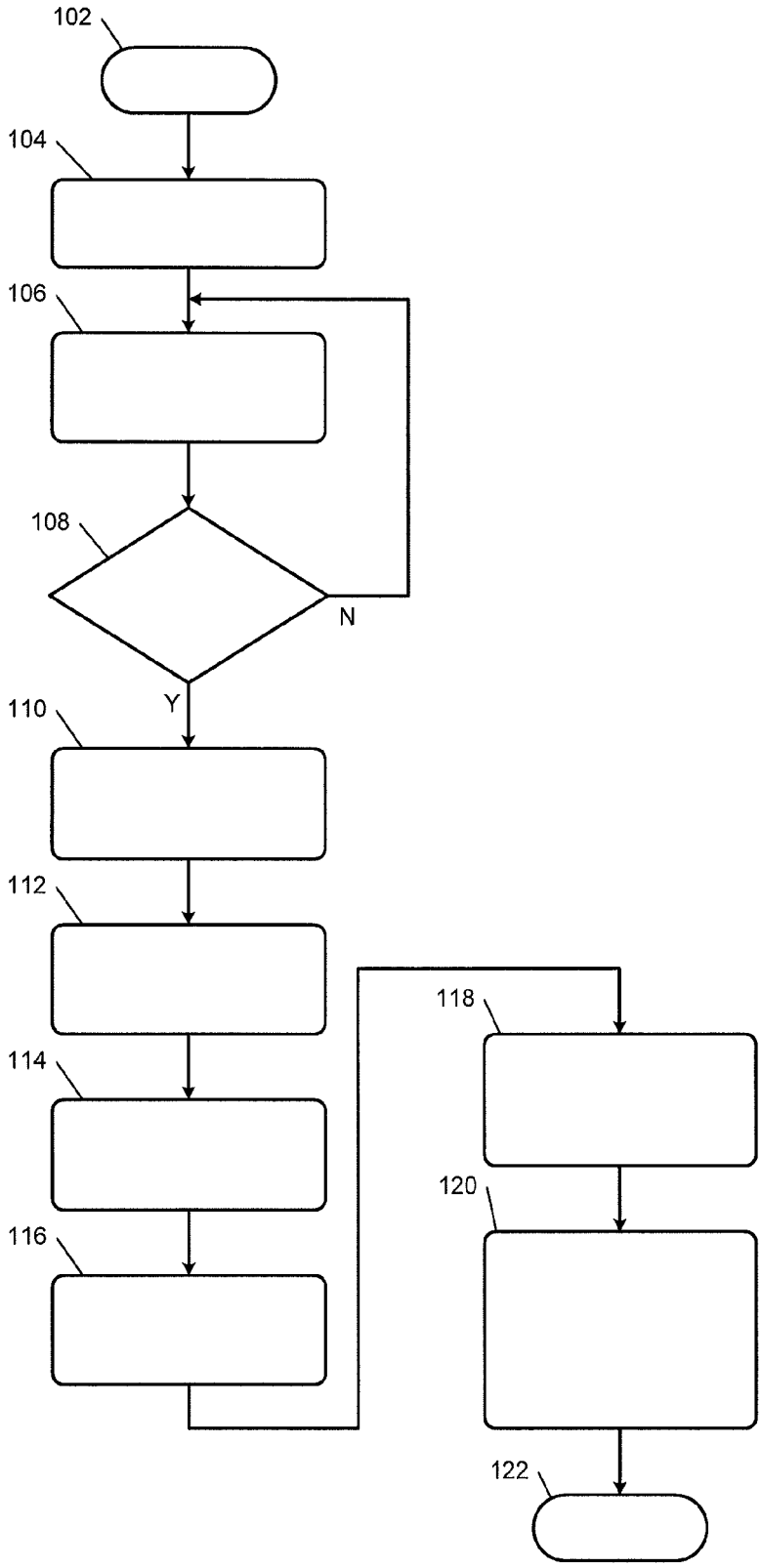
FIG. 3 is a method for providing a ground connection between a tray of a battery pack and a vehicle body rail through a coating disposed on the body rail.

With additional reference to FIG. 3, a method for providing the ground path 18 between the tray 12 and the body rail 16 through the coating 20 disposed on the body rail 16 begins at 102. At 104, an assembler installs the clinch nut 26 in the aperture 40 in the body rail 16. The assembler may then apply the force 41 to the clinch nut 26 to cause the piercing body 38 to bite into the body rail 16 and thereby fix the clinch not 26 to the body rail 16.

At 106, the assembler installs the grounding bushing 28 into the aperture 46 in the cover 14. At 108, the assembler determines whether the annular flange 52 is abutting the shoulder 54 on the cover 14. The assembler may determine that the annular flange 52 is abutting the shoulder 54 when the grounding bushing 28 cannot be inserted further into the aperture 46. If the annular flange 52 is abutting the shoulder 54, the method continues at 110. Otherwise, the method returns to 106. At 110, the assembler aligns the aperture 44 in the tray 12 with the aperture 46 in the cover 14 such that the central axes of the apertures 44 and 46 are collinear.

At 112, the assembler fastens the cover 14 to the tray 12 using a fastener (not shown). When the annular flange 52 of the grounding bushing 28 is abutting the shoulder 54 on the cover 14, the second surface 58 of the grounding bushing 28 may be flush with or protruding relative to an adjacent surface 62 on the cover 14. Thus, fastening the cover 14 to the tray 12 may place the second surface 58 of the grounding bushing 28 in contact with the tray 12. The grounding bushing 28 may also be mechanically fastened to the tray 12.

At 114, the assembler positions the cover 14 between the tray 12 and the body rail 16. At 116, the assembler aligns the aperture 44 in the tray and the aperture 60 in the grounding bushing 28 with the aperture 42 in the clinch nut 26. At 118, the assembler inserts the shank 32 of the bolt 22 through the aperture 44 in the tray, the aperture 60 in the grounding bushing 28, and the aperture 42 in the clinch nut 26 as shown in FIG. 1. In FIG. 1, the shank 32 of the bolt 22 may inserted into the aperture 42 in the clinch nut 26 but not yet threaded into the aperture 42, or the shank 32 may be only partially threaded into the aperture 42.

At 120, the assembler tightens the bolt 22 by fully threading the shank 32 of the bolt 22 into the aperture 42 in the clinch nut 26. As the bolt 22 is tightened, the piercing body 50 on the grounding bushing 28 pierces through the coating 20 on the body rail 16 and bites into (e.g., penetrates) the body rail 16. As a result, the grounding bushing 28 provides the ground path 18 between the tray 12 and the body rail 16 through the coating 20 disposed on the body rail 16. The method ends at 122.

In the example described above, a grounding bushing according to the present disclosure is used to provide a direct ground connection between a battery pack tray and a vehicle body rail. However, the grounding bushing may be used in a similar manner to provide a direct ground connection between another component and the body rail. For example, any component of a vehicle that needs to be grounded may be electrically connected to the body rail using the grounding bushing.

Thus, the present disclosure describes a grounding bushing and method of using the same to provide a direct ground connection between a vehicle component and a vehicle body rail. The method does not involve welding studs to the component and the body rail, assembling nuts to the studs during a coating process, removing the nuts, and reassembling the nuts to the studs to secure ground straps to the studs. As a result, the labor effort, labor time, and cost associated with providing a direct ground connection between the vehicle component and the vehicle body rail may be minimized.

While there are other methods for providing a direct ground connection between a battery pack tray and a vehicle body rail, these other methods also have drawbacks relative to using a grounding bushing according to the present disclosure. For example, referring again to FIG. 1, the portion of the body rail 16 surrounding the clinch nut 26 may be masked before the coating process, and the masking may be removed after the coating process. Then a bushing similar to the grounding bushing 28, but without the piercing body 50, may be used to provide a direct ground connection between the tray 12 and the masked portion of the body rail 16. However, applying and removing the masking increases labor time and cost.

In another example, the aperture 42 in the clinch nut 26 may not be threaded, and a threadforming fastener may be inserted through the tray 12 and into the clinch nut 26 to provide a direct ground connection between the tray 12 and the body rail 16. However, threadforming fasters are difficult to service, and it is difficult to ensure that threadforming fasteners are installed correctly (e.g., to the proper torque). In addition, a threadforming fastener would be susceptible to corrosion, especially as the coating on the body rail wears, and the serviceable life of threadforming fasteners is less than that of nonthreadforming fasteners. Further, including both threaded clinch nuts and unthreaded clinch nuts would lead to a proliferation of different body rails, which would increase the cost and complexity of the assembly process.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

None of the elements recited in the claims are intended to be a means-plus-function element within the meaning of 35 U.S.C. §112(f) unless an element is expressly recited using the phrase "means for," or in the case of a method claim using the phrases "operation for" or "step for."

What is claimed is:

1. A ground connection between a first component and a vehicle body rail through a coating disposed on the vehicle body rail, the ground connection comprising:

the first component;

the vehicle body rail;

a second component disposed between the first component and the vehicle body rail;

a fastener that secures the first component to the vehicle body rail; and a grounding bushing including:

an annular body inserted into an aperture in the second component, the annular body having a first surface facing the vehicle body rail and a second surface opposite of the first surface and contacting the first component, the annular body defining an aperture that receives the fastener; and a piercing body projecting from the first surface of the annular body and piercing through the coating disposed on the vehicle body rail to provide the ground connection between the first component and the vehicle body rail when the fastener is tightened to secure the first component to the vehicle body rail.

2. The ground connection of claim 1 wherein the annular body is secured within the aperture in the second component using a press fit.

3. The ground connection of claim 1 wherein the first component is formed of a non-conductive material.

4. The ground connection of claim 1 wherein the vehicle body rail is formed of a first material and the grounding bushing is formed of a second material that is harder than the first material.

5. The ground connection of claim 1 wherein the first component is a tray of a battery pack and the second component is a cover of the battery pack.

6. The ground connection of claim 1 wherein the coating includes at least one of an electro paint operation (ELPO) coating, a paint coating, and an oxidation coating.

7. A grounding bushing for providing a ground connection between a first component and a vehicle body rail through a coating disposed on the vehicle body rail, the grounding bushing comprising:

an annular body configured to be inserted into an aperture in a second component disposed between the first component and the vehicle body rail, the annular body having a first surface configured to face the vehicle body rail and a second surface opposite of the first surface and configured to contact the first component, the annular body defining an aperture configured to receive a fastener for securing the first component to the vehicle body rail;

a piercing body projecting from the first surface of the annular body and configured to pierce through the coating disposed on the vehicle body rail to provide the ground connection between the first component and the vehicle body rail when the fastener is tightened to secure the first component to the vehicle body rail; and an annular flange projecting radially outward from the annular body, the second component defining a shoulder against which the annular flange abuts when the annular body is inserted into the aperture in the second component.

8. The grounding bushing of claim 7 wherein the piercing body includes a ring projecting from the first surface of the annular body and having a sharp distal end.

9. The grounding bushing of claim 7 wherein the piercing body includes a plurality of teeth disposed on the first surface of the annular body.

10. The grounding bushing of claim 7 wherein when the annular flange abuts against the shoulder of the second component, the second surface of the annular body is one of flush with an adjacent surface of the second component or protrudes relative to the adjacent surface.

11. A method for providing a ground connection between a first component and a vehicle body rail through a coating disposed on the vehicle body rail, the method comprising:

inserting a grounding bushing into an aperture in a second component;

positioning the second component between the first component and the vehicle body rail;

placing the grounding bushing in contact with the first component;

inserting a fastener through the first component, through the grounding bushing, and into the vehicle body rail; and tightening the fastener to clamp the first component and the grounding bushing between a head of the fastener and the vehicle body rail and thereby cause the grounding bushing to pierce through the coating disposed on the vehicle body rail to provide the ground connection between the first component and the vehicle body rail.

12. The method of claim 11 further comprising securing the grounding bushing within the aperture in the second component using a press fit.

13. The method of claim 11 further comprising inserting a grounding bushing into the aperture in the second component until an annular flange on the grounding bushing abuts a shoulder on the second component.

14. The method of claim 11 further comprising:

aligning an aperture in the first component with an aperture in the grounding bushing; and inserting the fastener through the aperture in the first component, through the aperture in the second component, and into the vehicle body rail.

15. The method of claim 11 further comprising fastening the second component to the first component before inserting the fastener through the first component, through the grounding bushing, and into the vehicle body rail.

16. The method of claim 11 further comprising tightening the fastener by threading the fastener into a clinch nut mounted within an aperture in the vehicle body rail.

17. The method of claim 11 wherein the first component is formed of a non-conductive material.

18. The method of claim 11 wherein the vehicle body rail is formed of a first material and the grounding bushing is formed of a second material that is harder than the first material.

19. The method of claim 11 wherein the first component is a tray of a battery pack and the second component is a cover of the battery pack.

20. The method of claim 11 wherein the coating includes at least one of an electro paint operation (ELPO) coating, a paint coating, and an oxidation coating.

* * * * *